US009082564B2

(12) United States Patent
Yamada

(10) Patent No.: US 9,082,564 B2
(45) Date of Patent: Jul. 14, 2015

(54) KEY SUPPORT ARRANGEMENT FOR NARROW KEY SWITCH STRUCTURE

(75) Inventor: Shigeru Yamada, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 3 days.

(21) Appl. No.: 13/701,354

(22) PCT Filed: May 9, 2011

(86) PCT No.: PCT/JP2011/060652

§ 371 (c)(1),
(2), (4) Date: Nov. 30, 2012

(87) PCT Pub. No.: WO2012/002035

PCT Pub. Date: Jan. 5, 2012

(65) Prior Publication Data

US 2013/0078023 A1 Mar. 28, 2013

(30) Foreign Application Priority Data

Jun. 28, 2010 (JP) ..... 2010-146407

(51) Int. Cl.
*H01H 3/12* (2006.01)
*H01H 13/705* (2006.01)
*H01H 13/7065* (2006.01)

(52) U.S. Cl.
CPC ..... *H01H 13/705* (2013.01); *H01H 3/125* (2013.01); *H01H 13/7065* (2013.01); *H01H 3/122* (2013.01); *H01H 2221/026* (2013.01); *H01H 2221/058* (2013.01)

(58) Field of Classification Search
CPC ..... H01H 3/122; H01H 3/125
USPC ..... 400/496, 495, 490; 200/344
See application file for complete search history.

(56) References Cited

U.S. PATENT DOCUMENTS 4,433,225 A * 2/1984 Cowles ..... 200/344
5,329,084 A * 7/1994 Watanabe et al. ..... 200/344
6,723,935 B1 * 4/2004 Watanabe ..... 200/344

(Continued)

FOREIGN PATENT DOCUMENTS

JP 7-296673 A 11/1995
JP 11016440 A * 1/1999 ..... H01H 13/14

(Continued)

OTHER PUBLICATIONS

Japanese Office Action issued on May 13, 2014 with an English translation.

*Primary Examiner* — Daniel J Colilla
(74) *Attorney, Agent, or Firm* — Rabin & Berdo, P.C.

(57) ABSTRACT

A key switch structure which enables a reduction in the width of the key switch. A key switch structure comprises a first support member (22), a second support member (23), and a third support member which are arranged independently of each other, the first support member (22) having rotation pins (22*d*, 22*e*) and slide pins (22*a*, 22*b*), the second support member (23) having rotation pins (23*e*, 23*f*) and a circular columnar slide section (23*a*), the third support member having front end sections (24*d*, 24*e*), which are slidably held, and a support shaft section (24*a*). A key top (21) is supported by the support members (22, 23, 24) so that the key top (21) can move in the vertical direction. The length of at least one side of each of the support members is set to be less than or equal to the mounting diameter of a rubber dome (27).

2 Claims, 8 Drawing Sheets

(56) References Cited

U.S. PATENT DOCUMENTS

| | | | | |
|---|---|---|---|---|
| 6,880,994 | B2 * | 4/2005 | Takahashi | 400/472 |
| 7,319,202 | B2 * | 1/2008 | Sato | 200/344 |
| 7,728,243 | B2 * | 6/2010 | Lin et al. | 200/344 |
| 2010/0065409 | A1 * | 3/2010 | Yeh et al. | 200/5 A |
| 2011/0102323 | A1 * | 5/2011 | Chen | 345/168 |
| 2011/0303521 | A1 * | 12/2011 | Niu et al. | 200/517 |

FOREIGN PATENT DOCUMENTS

| | | | |
|---|---|---|---|
| JP | 11-039986 | A | 2/1999 |
| JP | 11-265632 | A | 9/1999 |
| JP | 2000-260254 | A | 9/2000 |
| JP | 2001-202849 | A | 7/2001 |
| JP | 2001-229764 | A | 8/2001 |
| JP | 2002-208327 | A | 7/2002 |
| TW | 201005780 | A | 2/2010 |

* cited by examiner

KEY SUPPORT ARRANGEMENT FOR NARROW KEY SWITCH STRUCTURE

TECHNICAL FIELD

The present invention relates to a structure of a key switch that is used in a personal computer or the like, and in particular, relates to a key switch structure that is used in thin, compact personal computers.

BACKGROUND ART

Conventionally, in a keyboard that is used in a portable personal computer or the like, the so-called operability, in which a key top descends without tilting regardless of which portion of the key top is pushed, is ensured. To this end, a conventional key switch structure has a link mechanism at the lower portion of the key top. For example, there is the structure disclosed in Japanese Patent Application Laid-Open No. 2001-229764 as a key switch structure having a link mechanism at the lower portion of the key top.

The conventional key switch structure, that is equipped with a link mechanism and is disclosed in the aforementioned document, is shown in FIG. 16. In FIG. 16, a conventional key switch 10 is structured from a key top 11, a first link member 12 that is provided so as to be able to rotate with respect to the key top 11, a second link member 13 that is provided so as to be able to swing with respect to the key top 11, a rubber dome (elastic restoring member) 14 that bends due to the key top 11 being pushed-down, and restores the key top 11 to the original position when the push-down force is eliminated, a holder 15 that holds the first, second link members 12, 13, a membrane sheet 16 having a contact portion 16*a* directly beneath the rubber dome 14, and a back plate 17 to which the holder 15 is fixed. A link mechanism is structured by the first link member 12 and the second link member 13.

Further, an embossed portion 17*a* that projects upward is formed at the back plate 17, and this embossed portion 17*a* is set in a through-hole 16*b* that is formed in the membrane sheet 16. Further, a pin 15*a* for welding is formed at the lower portion of the holder 15, and this pin 15*a* for welding is set in a hole 17*b* that is formed in the embossed portion 17*a* of the back plate 17. In the state in which the pin 15*a* for welding is set in the hole 17*b*, the back plate 17 is welded to the holder 15 with the membrane sheet 16 sandwiched therebetween.

In the above-described key switch structure, even if an end portion of the key top 11 is pushed-down, the key top 11 descends while the horizontal state is maintained by the link mechanism that is formed from the first, second link members 12, 13. For example, when the position of the end portion of the key top 11 shown by arrow A in FIG. 16 is pushed-down, first, the right end portion of the first link member 12 descends. The left end portion of the first link member 12 moves toward the left side. Due thereto, the central portion of the first link member 12 descends, and the second link member 13, that is connected to the first link member 12 at the central portion, also descends. Due to the descending of the second link member 13, the left end portion of the key top 11 also descends. Due to the key top 11 descending while maintaining a horizontal state even if an end portion of the key top 11 is pushed-down in this way, it is made such that there is no difference in the operation sensation depending on the push-down position, i.e., such that the operability is ensured.

DISCLOSURE OF INVENTION

Technical Problem

However, in the above-described, conventional key switch structure, the link mechanism, which is structured by the first link member and the second link member, is disposed so as to surround the rubber dome. Namely, portions, where the first link member and the second link member overlap in the horizontal direction, are positioned at both sides of the rubber dome. Therefore, wider spaces for placing the link mechanism are needed at both sides of the rubber dome, and there is the problem that it is difficult to make the width of the key switch narrow.

Further, in the conventional key switch structure, among the first link member and the second link member that structure the link mechanism, the holder side of one link member is made to be slidable, and the key top side of the other link member is made to be slidable. Therefore, there is the problem that, when the key top is pushed-down, the key top descends while becoming offset in the horizontal direction.

Solution To Problem

In order to overcome the above-described problems, in a key switch structure in which a key top is pushed-down and makes a contact conductive, and the key top is returned to an original position by a restoring member, the present invention has the feature of comprising plural supporting members that support the key top so as to be movable vertically, wherein at least one side of each of the plural supporting members is less than or equal to a placement diameter of the restoring member. A holding portion, that holds the key top in a horizontal state when not pushed-down, may be provided at at least one supporting member among the plurality of supporting members. Further, there may be provided a first restricting portion that restricts positional offset, in a predetermined direction, of at least one supporting member among the plurality of supporting members, and a second restricting portion that restricts positional offset, in the predetermined direction, of the key top with respect to the at least one supporting member.

Advantageous Effects of Invention

In accordance with the present invention, a structure in which the supporting members are not disposed at the periphery of the restoring member is possible, and a narrow-width key switch can be provided. Further, by providing the holding portion, that holds the key top, when not pushed-down, in a horizontal state, at at least one supporting member among the plural supporting members, the key top, when not pushed down, can be held in a horizontal state. Further, by providing the first restricting portion that restricts positional offset, in a predetermined direction, of at least one supporting member among the plural supporting members, and the second restricting portion that restricts positional offset, in the predetermined direction, of the key top with respect to the at least one supporting member, there can be made to be a structure in which horizontal direction offset of the key top does not arise when the key top is pushed-down.

BEST MODES FOR CARRYING OUT THE INVENTION

Figure 1:
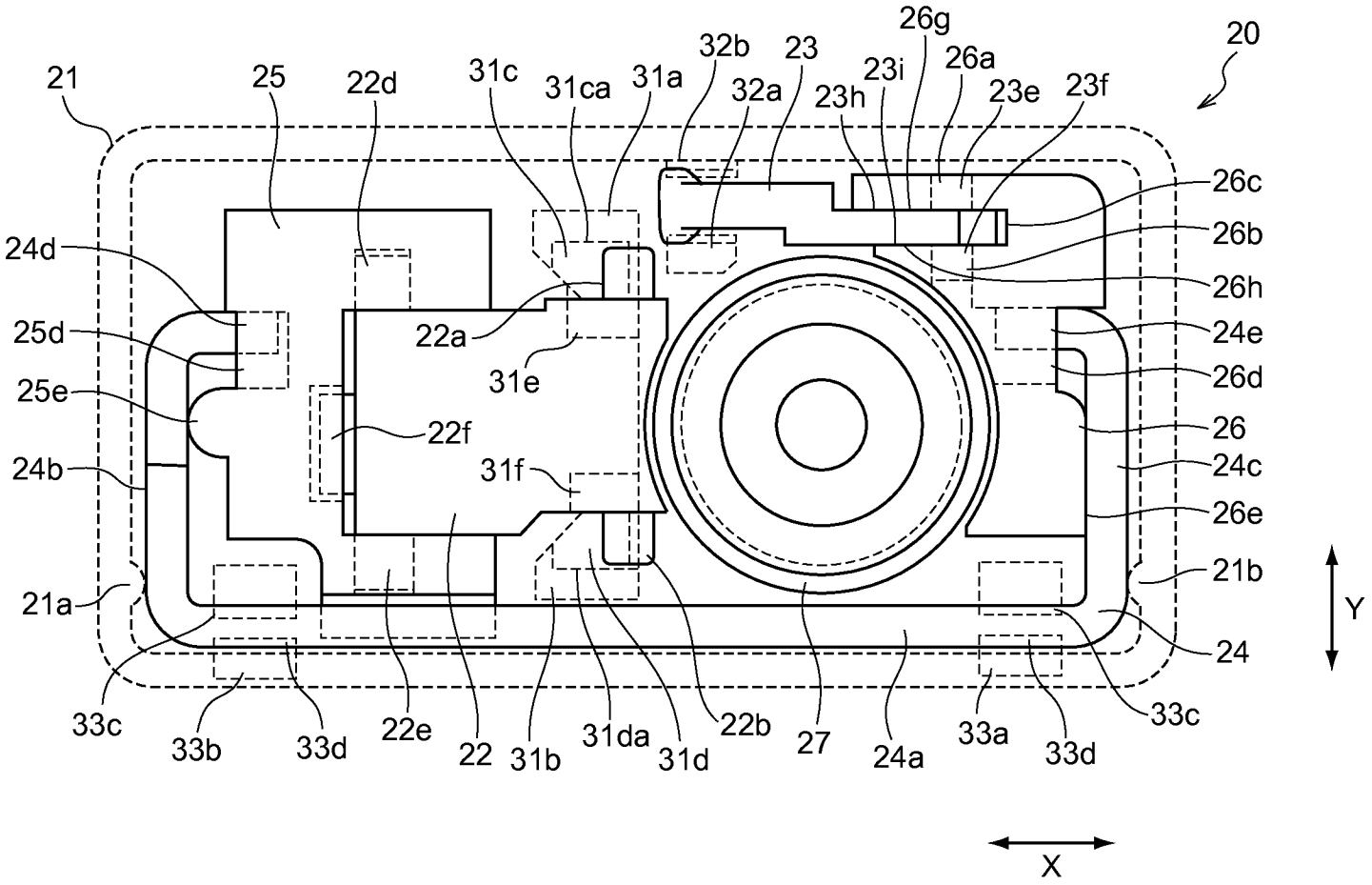
FIG. 1 is a plan view showing a key switch structure of embodiment 1 of the present invention.

Embodiments of the present invention are described hereinafter in accordance with the drawings. FIG. 1 is a plan view showing a key switch structure of embodiment 1 of the present invention, and FIG. 2 is a side view showing the key switch structure of embodiment 1.

Embodiment 1

Figure 2:
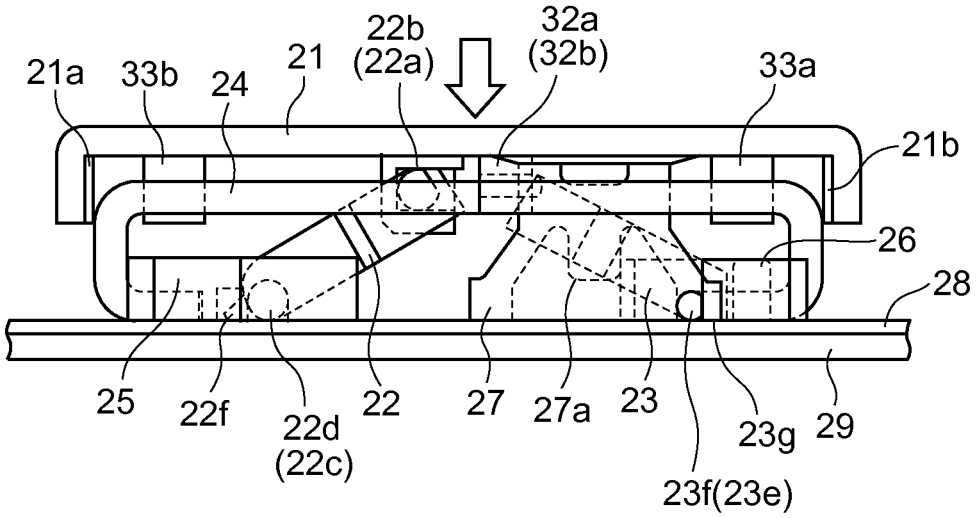
FIG. 2 is a side view showing the key switch structure of embodiment 1.

In FIG. 1 and FIG. 2, a key switch 20 of embodiment 1 has a key top 21, a first supporting member 22 that supports the key top 21 so as to be vertically movable, a second supporting member 23 and a third supporting member 24, a holder 25 that holds the first supporting member 22 and the third supporting member 24, a second holder 26 that holds the second supporting member 23 and the third supporting member 24, a rubber dome (restoring member) 27 that bends when the key top 21 is pushed-down, and that restores the key top 21 to the original position when the push-down force is eliminated, a membrane sheet 28 that has an unillustrated contact portion directly beneath the rubber dome 27, and a back plate 29. Note that, in FIG. 1, the key top 21 is shown by the dashed line for convenience of explanation.

Figure 3:
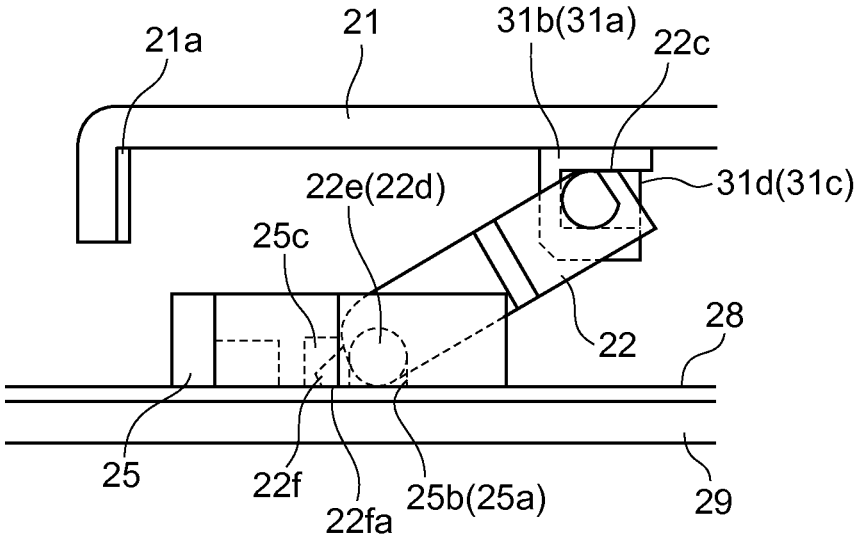
FIG. 3 is a side view showing a first supporting portion of embodiment 1, and the periphery thereof.

A pair of first sliding/holding portions 31*a*, 31*b*, a pair of second sliding/holding portions 32*a*, 32*b*, and a pair of rotating/holding portions 33*a*, 33*b* are provided at the bottom surface of the key top 21. As shown in FIG. 1 and FIG. 3, the first sliding/holding portions 31*a*, 31*b* have groove portions 31*c*, 31*d* that sliding pins 22*a*, 22*b*, that are formed at both side surfaces of one end portion of the first supporting member 22, slidingly engage with. When the key top 21 is pushed-down and when the key top 21 returns to the original position from the pushed-down state, the sliding pins 22*a*, 22*b* slide within the groove portions 31*c*, 31*d*. Further, the position of the key top 21 in an arrow Y direction shown in FIG. 1 is restricted by the positions of outer side walls 31*ca*, 31*da* of the groove portions 31*c*, 31*d* being restricted by the distal end portions of the sliding pins 22*a*, 22*b*. Note that FIG. 3 is a side view showing a first supporting portion and the periphery thereof.

Figure 4:
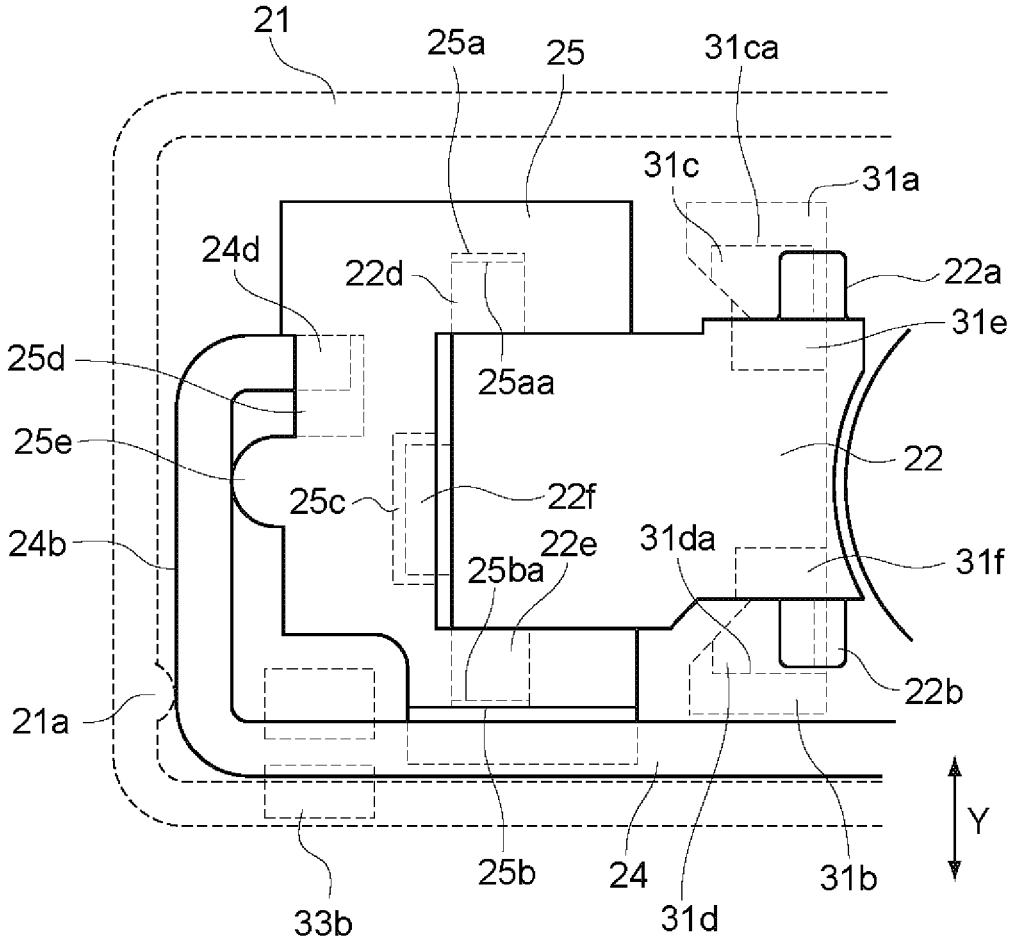
FIG. 4 is an enlarged plan view showing a first supporting member of embodiment 1, and the periphery thereof.

FIG. 4 is an enlarged plan view showing the first supporting member and the periphery thereof. In FIG. 3 and FIG. 4, the upper portions of the first sliding/holding portions 31*a*, 31*b* are respectively extended in the central direction of the arrow Y direction of the key top 21. When the key top 21 is not pushed-down, a chamfered portion 22*c* (shown in FIG. 3), that is formed at an end portion of the first supporting member 22, planarly-contacts the bottom surfaces of these extended portions 31*e*, 31*f*. Due to the chamfered portion 22*c* planarly-contacting the bottom surfaces of the extended portions 31*e*, 31*f*, the key top 21 is positioned and held in a stable state when not pushed-down.

Rotating pins 22*d*, 22*e* are formed at the both side surfaces of the other end portion of the first supporting member 22, and the rotating pins 22*d*, 22*e* respectively are rotatably fit-into groove portions 25*a*, 25*b* that are formed in the first holder 25. The position of the first supporting member 22 in the arrow Y direction shown in FIG. 1 is restricted by the positions of distal end portions of the rotating pins 22*d*, 22*e* being restricted by deep walls 25*aa*, 25*ba* of the groove portions 25*a*, 25*b*, respectively. A projecting portion 22*f* is provided at the distal end side of the other end portion of the first supporting member 22. As shown in FIG. 3, the projecting portion 22*f* is a portion that restricts the rotation angle of the first supporting member 22, and a taper surface 22*fa*, that planarly-contacts the membrane sheet 28 when the first supporting member 22 rotates to a predetermined angle, is formed at the projecting portion 22*f*. As shown in FIG. 4, the projecting portion 22*f* is rotatably set in a groove portion 25*c* of the first holder 25.

Figure 5:
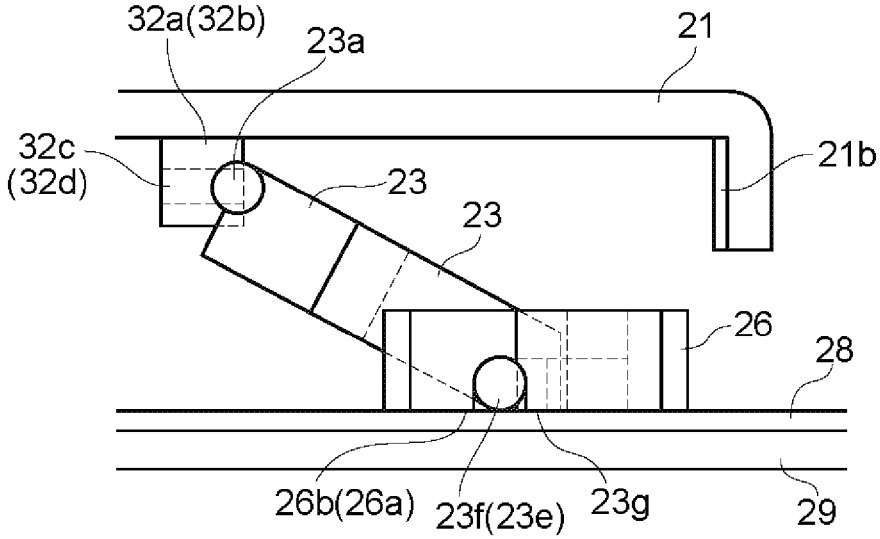
FIG. 5 is a side view showing a second supporting portion and the periphery thereof.
Figure 6:
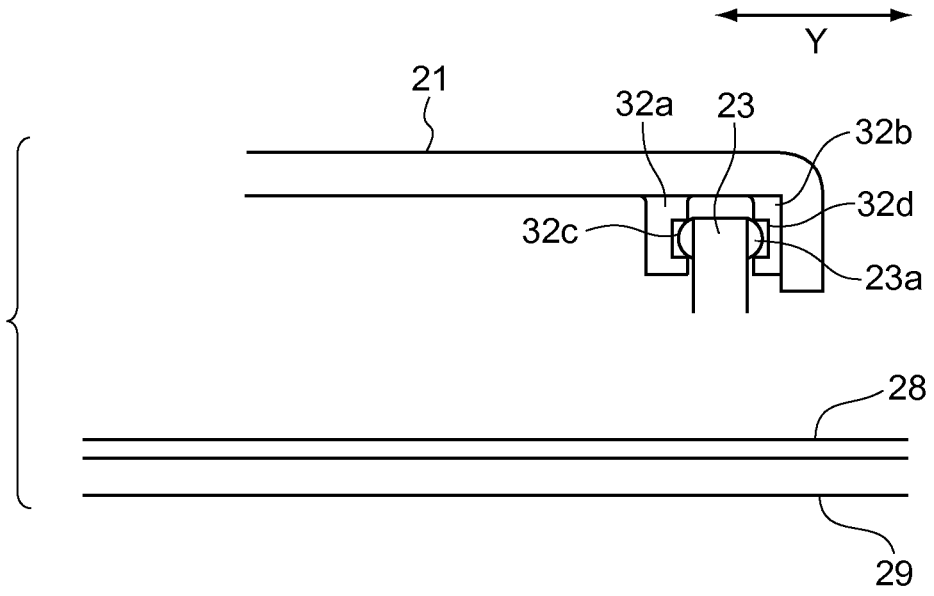
FIG. 6 is a side view showing a second sliding/holding portion.

As shown in FIG. 5 and FIG. 6, the second sliding/holding portions 32*a*, 32*b* have groove portions 32*c*, 32*d* that both end portions of a sliding cylindrical portion 23*a*, that is formed at both side surfaces of one end portion of the second supporting member 23, slidably engage with. When the key top 21 is pushed-down and when the key top 21 returns to the original position from the pushed-down state, the sliding cylindrical portion 23*a* slides within the groove portions 32*c*, 32*d*. Further, the position of the key top 21 in the arrow Y direction shown in FIG. 6 is restricted by the both end portions of the sliding cylindrical portion 23*a* engaging with the groove portions 32*c*, 32*d*, respectively. Note that FIG. 5 is a side view showing the second supporting member and the periphery thereof, and FIG. 6 is a side view showing the second sliding/holding portions.

In FIG. 1 and FIG. 5, rotating pins 23*e*, 23*f* are formed at the both side surfaces of the other end portion of the second supporting member 23, and the rotating pins 23*e*, 23*f* respectively are rotatably fit-into groove portions 26*a*, 26*b* that are formed in the second holder 26. The position of the second supporting member 23 in the arrow Y direction shown in FIG. 1 is restricted by the positions of distal end portions of the rotating pins 23*e*, 23*f* being restricted by deep walls of the groove portions 26*a*, 26*b*, respectively. A chamfered portion 23*g* is formed at the other end portion of the second supporting member 23. As shown in FIG. 5, the chamfered portion 23*g* is a portion that restricts the rotation angle of the second supporting member 23, and planarly-contacts the membrane sheet 28 when the second supporting member 23 rotates to a predetermined angle. The other end portion of the second supporting member 23 is rotatably set in a groove portion 26*c* of the second holder 26.

As can be understood from FIG. 1 and FIG. 5, the second supporting member 23 is formed from a crank-shaped prism, and the position of the second supporting member 23 in the arrow Y direction shown in FIG. 1 is restricted also due to side surfaces 23*h*, 23*i* thereof slidingly-contacting inner wall portions 26*g*, 26*h* of the second holder 26. Further, the shapes of the supporting members can be changed in accordance with the shape and the size of the key switch or the placement of the rubber dome or the like, such as forming the second supporting member 23 in a crank shape in the present embodiment, and flexible accommodation is possible.

Figure 7:
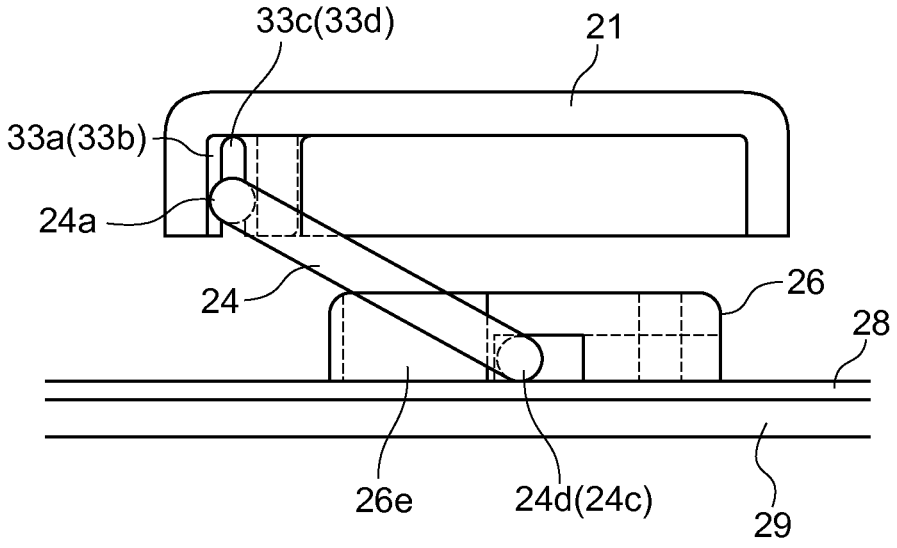
FIG. 7 is a side view showing a third supporting member and the periphery thereof.

The pair of rotating/holding portions 33*a*, 33*b* rotatably hold the third supporting member 24. Namely, as shown in FIG. 1 and FIG. 7, the rotating/holding portions 33*a*, 33*b* respectively have groove portions 33*c*, 33*d* that rotatably hold a pivot portion 24*a* of the third supporting member 24. When the key top 21 is pushed-down and when the key top 21 returns to the original position from the pushed-down state, the pivot portion 24*a* rotates within the groove portions 33*c*, 33*d*. FIG. 7 is a side view showing the third supporting member and the periphery thereof.

The third supporting member 24 is approximately formed in a substantial U-shape, and, in addition to the pivot portion 24*a*, has side end portions 24*b*, 24*c* and distal end portions 24*d*, 24*e*. As shown in FIG. 1, one of the distal end portions 24*d* is fit into a groove portion 25*d*, that is formed in the first holder 25, so as to be slidable in the arrow Y direction. A projecting portion 25*e* is formed at the first holder 25, and the distal end portion of the projecting portion 25*e* abuts the inner side of the side end portion 24*b* of the third supporting member 24. Further, a fixing wall 21*a* is formed to project at the inner side of an end portion of the key top 21, and the fixing wall 21*a* abuts the outer side of the side end portion 24*b* of the third supporting member 24. Namely, the side end portion 24*b* of the third supporting member 24 is slidably held by the above-described projecting portion 25*e* and fixing wall 21*a*. The side end portion 24*b* of the third supporting member 24 rotatingly operates accompanying the pushing-down of the key top 21, but the projecting portion 25*e* and the fixing wall 21*a* are formed in shapes and at positions so as to always abut the side end portion 24*b* even if the side end portion 24*b* rotatingly operates.

As shown in FIG. 1, the other distal end portion 24*e* of the third supporting member 24 is fit into a groove portion 26*d*, that is formed in the second holder 26, so as to be slidable in the arrow Y direction. A wall portion 26*e* is formed at the second holder 26, and the wall portion 26*e* abuts the inner side of the side end portion 24*c* of the third supporting member 24. Further, a fixing wall 21*b* is formed to project at the inner side of an end portion of the key top 21, and the fixing wall 21*b* abuts the outer side of the side end portion 24*c* of the third supporting member 24. Namely, the side end portion 24*c* of the third supporting member 24 is slidably held by the above-described wall portion 26*e* and fixing wall 21*b*. The wall portion 26*e* and the fixing wall 21*b* are formed in shapes and at positions so as to always abut the side end portion 24*c* even if the side end portion 24*c* of the third supporting member 24 rotatingly operates.

Figure 8:
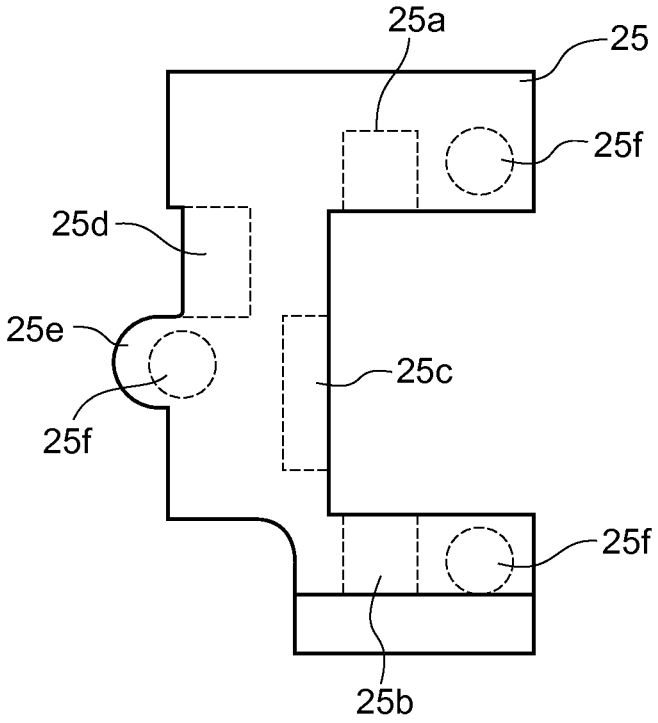
FIG. 8 is a plan view showing a first holder.
Figure 9:
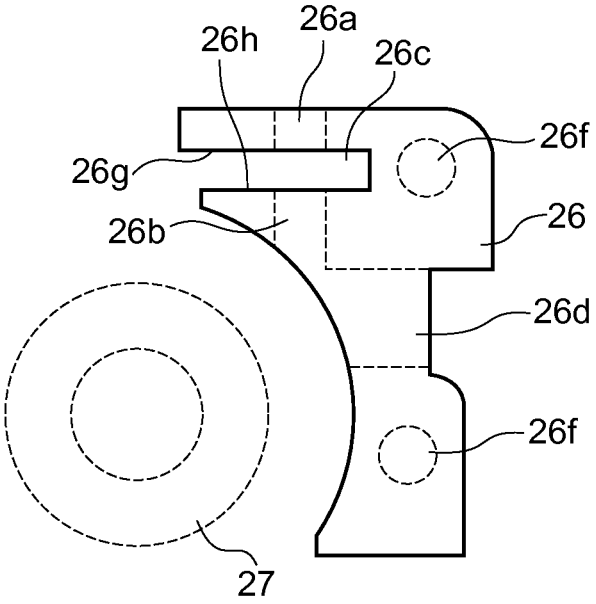
FIG. 9 is a plan view showing a second holder.
Figure 10:
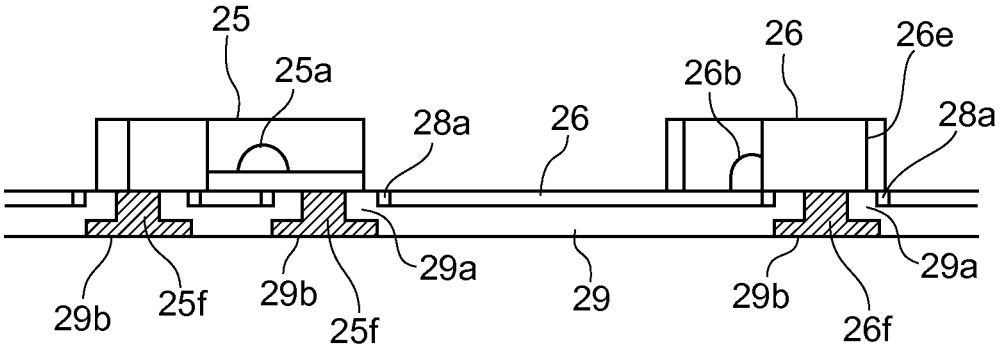
FIG. 10 is an explanatory drawing showing a fixed state of the first holder and the second holder.

FIG. 8 is a plan view showing the first holder. In FIG. 8, plural (three) pins 25*f* for fixing are provided at the first holder 25, and further, as shown in FIG. 9, plural (two) pins 26*f* for fixing are provided at the second holder 26 as well. These pins 25*f*, 26*f* for fixing are inserted in and welded to holes 29*b* that are formed in embossed portions 29*a* that are formed at the back plate 29 shown in FIG. 10. The top portions of the embossed portions 29*a* are inserted into holes 28*a* that are formed in the membrane sheet 28, and the first holder 25 and the second holder 26 are directly fixed to the back plate 29.

As shown in FIG. 2, the rubber dome (restoring member) 27 is disposed between the membrane sheet 28 and the key top 21, and a projecting portion 27*a*, that pushes the membrane sheet 28 when the key top 21 is pushed-down, is formed at the rubber dome 27. Although not illustrated, a contact portion is provided at the membrane sheet 28 beneath the projecting portion 27*a*. The contact portion is made to be electrically conductive due to the projecting portion 27*a* pushing the contact portion.

Figure 11:
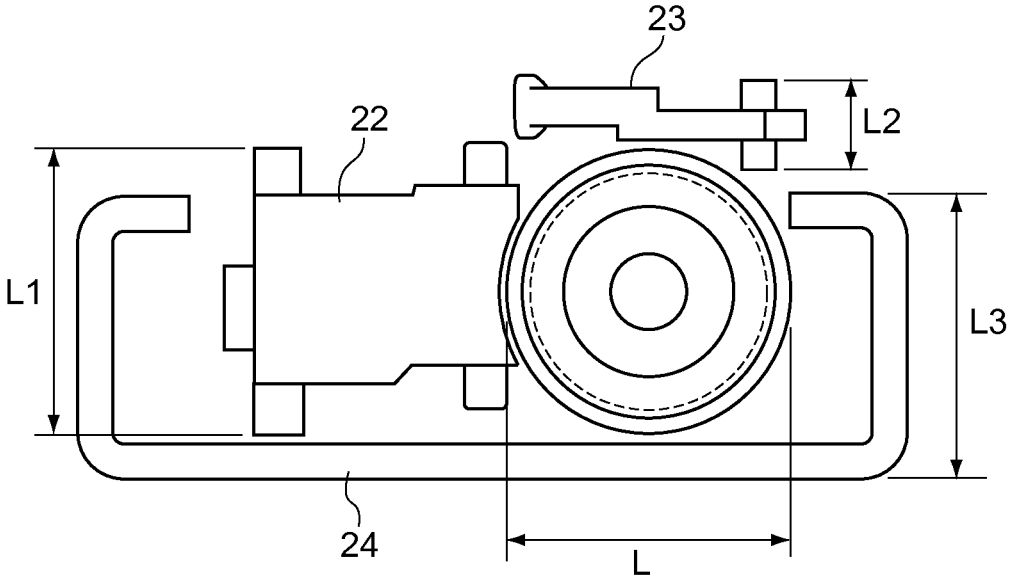
FIG. 11 is an explanatory drawing showing the relationship of sizes of the first supporting member, a second supporting member and the third supporting member, and a rubber dome.

FIG. 11 is an explanatory diagram showing the relationship of the sizes of the first supporting member 22, the second supporting member 23 and the third supporting member 24, and the rubber dome 27 of the present embodiment. In FIG. 11, the diameter (placement diameter) of the rubber dome 27 is L, the distance from the distal end of the sliding pin 22*a* of the first supporting member 22 to the distal end of the sliding pin 22*b* (the length of the short side when the first supporting member 22 is rectangular) is L1, the width of the supporting member 23 (similarly, the length of the short side when the second supporting member 23 is rectangular) is L2, and the width of the supporting member 24 (similarly, the length of the short side when the third supporting member 23 is rectangular) is L3.

In this case, in the present embodiment, L1, L2, L3 are all set to be less than or equal to the diameter L of the rubber dome 27 (L1≤L, L2≤L, L3≤L). Due thereto, the supporting members can be disposed without being hampered by the diameter of the rubber dome 27. Further, by making the supporting members be smaller than the diameter of the rubber dome 27, the supporting members themselves are made small, and, due thereto, the size of the key switch itself can be made to be small. Moreover, the shape of the key switch also can be addressed flexibly.

Operation of the present embodiment is described next. The state before the key top 21 is pushed-down is the state shown in FIG. 2. In this state, the taper surface 22*fa* of the projecting portion 22*f* of the first supporting member 22 planarly-contacts the membrane sheet 28, and further, the chamfered portion 22*c* formed at the end portion of the first supporting member 22 planarly-contacts the extended portions 31*e*, 31*f* of the first sliding/holding portions 31*a*, 31*b*, and therefore, the key top 21 is positioned and held in a stable state. Further, because the chamfered portion 23*g* formed at the second supporting member 23 planarly-contacts the membrane sheet 28, the key top 21 is held in a stable state due thereto as well.

Figure 12:
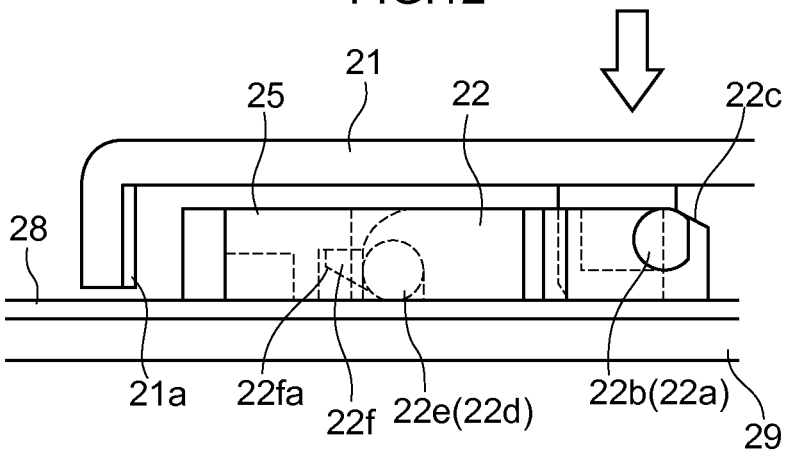
FIG. 12 is an explanatory drawing showing operation of the first supporting member.

When, from this state, the key top 21 is pushed-down in the direction of the arrow shown in FIG. 2, the first supporting member 22 rotates in the clockwise direction in FIG. 2 around the rotating pins 22*d*, 22*e*. At this time, the sliding pins 22*a*, 22*b* of the first supporting member 22 slide in the horizontal direction in the groove portions 31*c*, 31*d* of the first sliding/holding portions 31*a*, 31*b* of the key top 21. When the key top 21 is pushed-down to the lowest portion, the first supporting member 22 enters into a substantially horizontal state as shown in FIG. 12.

Figure 13:
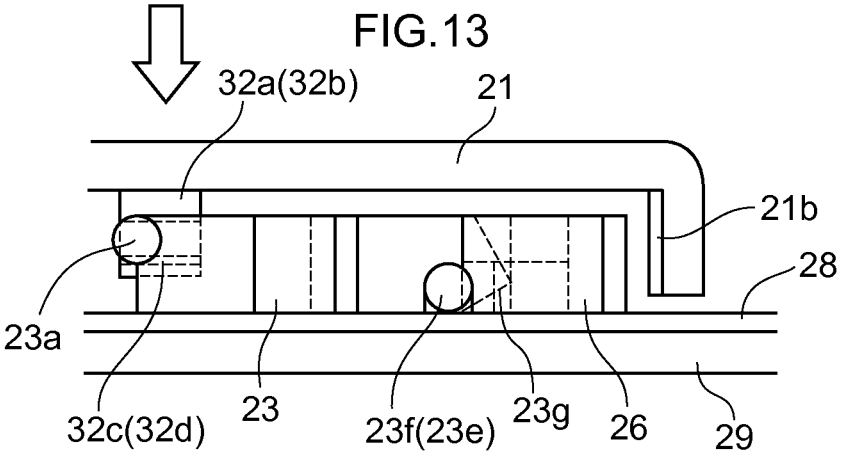
FIG. 13 is an explanatory drawing showing operation of the second supporting member.

Further, the second supporting member 23 rotates in the counterclockwise direction in FIG. 2 around the rotating pins 23*e*, 23*f*. At this time, the sliding cylindrical portion 23*a* slides in the horizontal direction within the groove portions 32*c*, 32*d* of the second sliding/holding portions 32*a*, 32*b*. When the key top 21 is pushed-down to the lowest portion, the second supporting member 23 enters into a substantially horizontal state as shown in FIG. 13.

Figure 14:
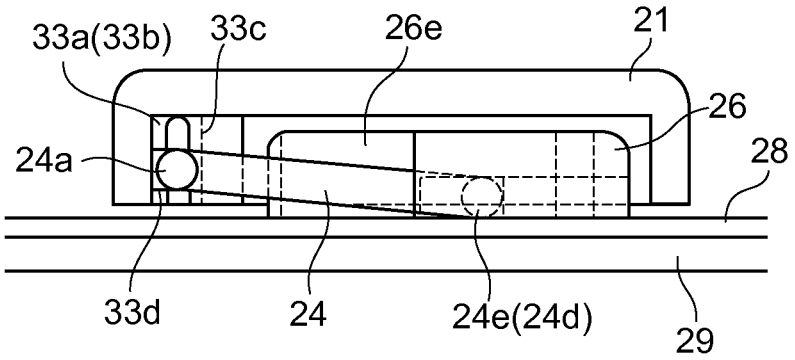
FIG. 14 is an explanatory drawing showing operation of the third supporting member.

The third supporting member 24 rotates, from the state shown in FIG. 7, in the counterclockwise direction around the pivot portion 24*a* that is held at the rotating/holding portions 33*a*, 33*b*. At this time, the distal end portions 24*d*, 24*e* of the third supporting member 24 slide in the horizontal direction within the groove portion 25*d* of the first holder 25 and the groove portion 26*d* of the second holder 26, respectively. When the key top 21 is pushed-down to the lowest portion, the third supporting member 24 enters into a substantially horizontal state as shown in FIG. 14.

When the above-described series of operations are carried out simultaneously, as shown in FIG. 4, positional offset in the arrow Y direction of the first supporting member 22 is restricted by the positions of the distal end portions of the rotating pins 22*d*, 22*e* being restricted by the deep walls 25*aa*, 25*ba* of the groove portions 25*a*, 25*b* of the first holder 25, respectively. Further, at the first sliding/holding portions 31*a*, 31*b*, positions of the outer side walls 31*ca*, 31*da* of the respective groove portions 31*c*, 31*d* are restricted by the distal end portions of the sliding pins 22*a*, 22*b* of the first supporting member 22, and, due thereto, positional offset of the key top 21 in the arrow Y direction is restricted.

Further, as shown in FIG. 1, positional offset of the second supporting member 23 in the arrow Y direction is restricted due to the side surfaces 23*h*, 23*i* thereof slidingly contacting the inner wall portions 26*g*, 26*h* of the second holder 26 and positions thereof being restricted. Further, at the second sliding/holding portions 32*a*, 32*b*, positions of the deep portions of the respective groove portions 32*c*, 32*d* are restricted by the distal end portions of the sliding cylindrical portion 23*a* of the second supporting member 23, and, due thereto as well, positional offset of the key top 21 in the arrow Y direction is restricted.

As shown in FIG. 1, positional offset in the arrow X direction of the third supporting member 24 is restricted by the inner side of the one side end portion 24*b* abutting the projecting portion 25*e* of the first holder 25 and the inner side of the other side end portion 24*c* abutting the wall portion 26*e* of the second holder 26. Further, the fixing wall 21*a*, that is formed at the key top 21 so as to face the inner side, abuts the outer side of the side end portion 24*b* of the third supporting member 24, and the fixing wall 21*b*, that is formed at the opposite side of the key top 21 so as to similarly face the inner side, abuts the outer side of the other side end portion 24*c* of the third supporting member 24. Due thereto, positional offset of the key top 21 in the arrow X direction is restricted. When the key top 21 is pushed-down as described above, the position of the key top 21 does not become offset in either the arrow X direction or the arrow Y direction, and further, the key top 21 does not tilt nor rotate, and the key top 21 descends vertically with respect to the pushing-down in the vertical direction by the operator.

The key top 21 maintains a horizontal state, and descends in the vertical direction. Due thereto, the rubber dome 27 is pushed by the reverse surface of the key top 21 and buckles. The projecting portion 27*a* of the rubber dome 27 that has buckled pushes the unillustrated contact portion of the membrane sheet 28, and the key switch becomes electrically conductive. When the operator eliminates the push-down force with respect to the key top 21, the key top 21 is pushed-upward by the restoring force of the rubber dome 27 and moves upward, and accompanying this, the first supporting member 22, the second supporting member 23 and the third supporting member 24 respectively carry out operations in directions opposite to those at the time of pushing-down, and the key top 21 moves upward while maintaining the horizontal state.

As described above, in accordance with embodiment 1, at least one side of each of the first supporting member 22, the second supporting member 23 and the third supporting member is less than or equal to the placement diameter of the rubber dome 27. Therefore, by placing the supporting members so as to not surround the rubber dome 27, the width of the key switch can be made to be narrow. Further, the size of the rubber dome 27 can be made to be large in proportion to the size of the key top 21, and therefore, lengthening of the stroke of the key switch and extending of the lifespan thereof can be devised. Moreover, the projecting portion 22*f* and the chamfered portion 22*c*, that are for restricting the angle of rotation, are formed at the first supporting member 22, and further, the chamfered portion 23*g* is formed at the second supporting member 23 as well. Therefore, when the key top 21 is not pushed-down, the key top 21 can reliably maintain a horizontal state. Moreover, because the key switch structure has functions for preventing positional offset of the key top 21, when the key top 21 is pushed-down, the key top 21 descends in the vertical direction without the position thereof being offset in either the X direction or the Y direction.

Embodiment 2

Figure 15:
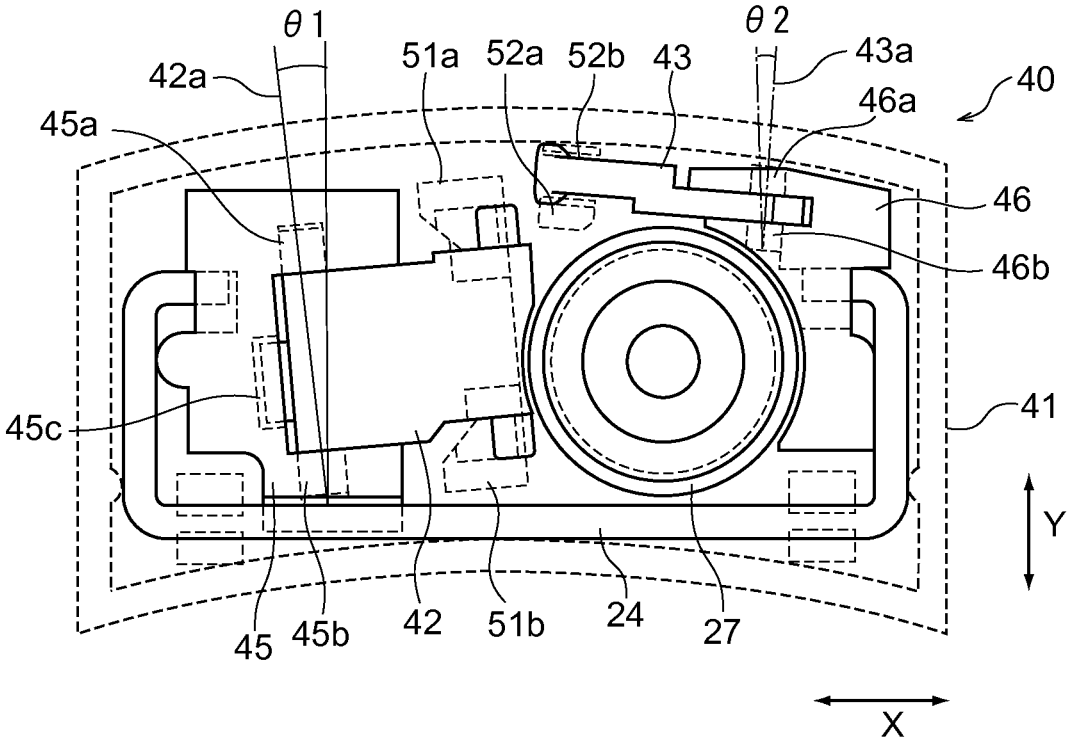
FIG. 15 is a plan view showing a key switch of embodiment 2.
Figure 16:
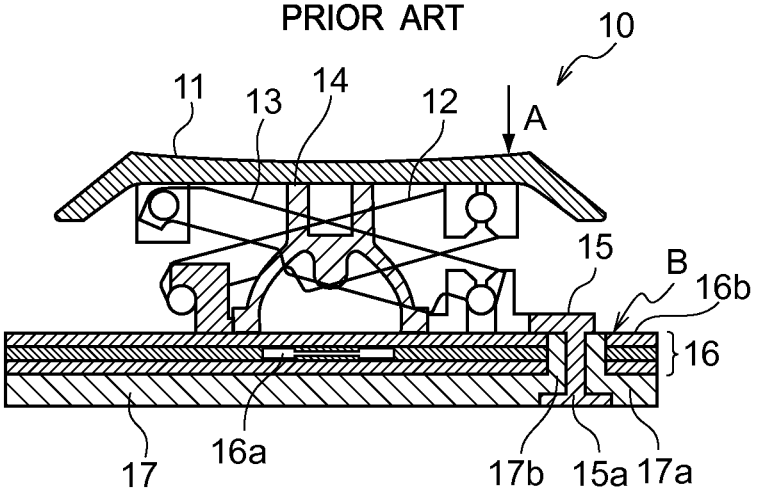
FIG.16 PRIOR ART
FIG. 16 is a cross-sectional view showing a conventional key switch structure that is equipped with a link mechanism.

Embodiment 2 is described next. FIG. 15 is a plan view showing a key switch of embodiment 2. In FIG. 15, a key switch 40 of embodiment 2 has a key top 41, a first supporting member 42 that supports the key top 41 so as to be vertically movable, a second supporting member 43 and the third supporting member 24, a holder 45 that holds the first supporting member 42 and the third supporting member 24, a second holder 46 that holds the second supporting member 43 and the third supporting member 24, the rubber dome 27 that bends when the key top 41 is pushed-down, and that restores the key top 41 to the original position when the push-down force is eliminated, a membrane sheet that has an unillustrated contact portion directly beneath the rubber dome 27, and a back plate. (The membrane sheet and the back plate are not illustrated.)

The planar shape of the key top 41 is not rectangular, and is a curved shape. The first supporting member 42 is a similar shape as and is similarly rotatable as the first supporting member 22 of embodiment 1, but a rotating shaft 42*a* thereof is displaced, by angle θ1 with respect to the arrow Y direction, in a direction that runs along the shape of the key top 41. Accompanying this, groove portions 45*a*, 45*b*, 45*c* of the first holder 45 are formed so as to be inclined by the angle θ1 with respect to the arrow Y direction, as compared with those of embodiment 1, and further, first sliding/holding portions 51*a*, 51*b* also are disposed so as to be inclined by angle θ1 with respect to the arrow Y direction.

Further, the second supporting member 43 as well is a similar shape as and is similarly rotatable as the second supporting member 23 of embodiment 1, but a rotating shaft 43*a* thereof is displaced, by angle θ2 with respect to the arrow Y direction, in a direction that runs along the shape of the key top 41. Accompanying this, groove portions 46*a*, 46*b* of the second holder 26 are formed so as to be inclined by the angle θ2 with respect to the arrow Y direction, as compared with those of embodiment 1, and second sliding/holding portions 52*a*, 52*b* also are disposed so as to be inclined by angle θ2 with respect to the arrow Y direction. The other structures are similar to embodiment 1.

In embodiment 2 that has the above-described structure, the operation due to the pushing-down of the key top 41 is similar to above-described embodiment 1. In embodiment 2, by disposing the first supporting member 42 and the second supporting member 43 at an incline, the first supporting member 42 and the second supporting member 43 can be disposed along the shape of the key top 41. By disposing the first supporting member 42 and the second supporting member 43 along the shape of the key top 41, regardless of what portion of the top surface of the key top 41 is pushed-down, the key top 41 can descend while maintaining a horizontal state, without tilting.

Although the above-described respective embodiments describe examples in which three of the supporting members are provided, in the present invention, the number of supporting members is not limited to three, and may be two or four or another number. Further, the above-described embodiments illustrate examples in which supporting members of three types of shapes that are plate-shaped (the first supporting member), prism shaped (the second supporting member) and round bar shaped (the third supporting member) are used as the shapes of the supporting members, but what shape of supporting member is to be used can be selected in accordance with the size and the shape of the key switch. For example, when the key switch is large, plate-shaped supporting members can be used, and, when the key switch is long and narrow, round bar shaped supporting members can be used.

Moreover, in the above-described embodiments, the first supporting member and the second supporting member are crank-shaped, and by making them be crank-shaped, flexibility is provided to the arrangement of the supporting members, and the supporting members can be set in an arrangement that better corresponds to the shape of the key switch. Namely, the crank shapes of the supporting members can be changed flexibly in accordance with the shape of the key switch and the placed positions.

Industrial Applicability

The key switch structure of the present invention is used in keyboard devices that are used as input devices in information processors, measuring devices, medical equipment, and the like, and in particular, is used in keyboard devices that serve as input devices for compact, thin personal computers.

The invention claimed is:

1. A key switch structure in which a key top is pushed-down and makes contact with a conductor, and the key top is returned to an original position by a restoring member, the key switch structure comprising:

a plurality of supporting members that support the key top so as to be movable vertically;

wherein the length of at least one side of each of the plurality of supporting members is less than or equal to a placement diameter of the restoring member;

wherein the key switch structure further comprises a first restricting portion that restricts positional offset, in a predetermined direction, of at least one supporting member among the plurality of supporting members, and a second restricting portion that restricts positional offset, in the predetermined direction, of the key top with respect to the at least one supporting member;

wherein the key switch structure further comprises a third restricting portion that restricts positional offset, in a direction that is different than the predetermined direction, of a supporting member other than the at least one supporting member among the plurality of supporting members, and a fourth restricting portion that restricts positional offset, in the direction that is different than the predetermined direction, of the key top with respect to the supporting member other than the at least one supporting member;

wherein the first and second restricting portions also restrict positional offsets of the at least one supporting member and the key top, respectively, in a direction opposite to the predetermined direction;

wherein the third and fourth restricting portions also restrict positional offsets of the other one of the supporting members and the key top, respectively, in a direction opposite to the direction that is different than the predetermined direction; and wherein the first restricting portion is configured by positions of distal end portions of rotating pins of one of the supporting members being restricted by deep walls of groove portions in a holder, and the second restricting portion is configured by positions of sliding/holding portions provided at the key top being restricted by distal end portions of sliding pins of the one of the supporting members.

2. A key switch structure in which a key top is pushed-down and makes contact with a conductor, and the key top is returned to an original position by a restoring member, the key switch structure comprising:

a plurality of supporting members that support the key top so as to be movable vertically;

wherein the length of at least one side of each of the plurality of supporting members is less than or equal to a placement diameter of the restoring member;

wherein the key switch structure further comprises a first restricting portion that restricts positional offset, in a predetermined direction, of at least one supporting member among the plurality of supporting members, and a second restricting portion that restricts positional offset, in the predetermined direction, of the key top with respect to the at least one supporting member;

wherein the key switch structure further comprises a third restricting portion that restricts positional offset, in a direction that is different than the predetermined direction, of a supporting member other than the at least one supporting member among the plurality of supporting members, and a fourth restricting portion that restricts positional offset, in the direction that is different than the predetermined direction, of the key top with respect to the supporting member other than the at least one supporting member;

wherein the first and second restricting portions also restrict positional offsets of the at least one supporting member and the key top, respectively, in a direction opposite to the predetermined direction;

wherein the third and fourth restricting portions also restrict positional offsets of the other one of the supporting members and the key top, respectively, in a direction opposite to the direction that is different than the predetermined direction; and wherein the third restricting portion is configured by inner sides of both side end portions of the other one of the supporting members abutting a holder, and the fourth restricting portion is configured by fixing walls formed at the key top abutting end portions of the other one of the supporting members.

* * * * *